US009354595B2

(12) United States Patent
Tsuchiya

(10) Patent No.: US 9,354,595 B2
(45) Date of Patent: May 31, 2016

(54) TONER CONTAINER AND IMAGE FORMING APPARATUS INCLUDING THE TONER CONTAINER

(71) Applicant: KYOCERA Document Solutions Inc., Osaka-shi, Osaka (JP)

(72) Inventor: Hiroaki Tsuchiya, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/327,487

(22) Filed: Jul. 9, 2014

(65) Prior Publication Data

US 2015/0016847 A1 Jan. 15, 2015

(30) Foreign Application Priority Data

Jul. 12, 2013 (JP) ..... 2013-147037

(51) Int. Cl.
*G03G 21/16* (2006.01)
*G03G 15/08* (2006.01)

(52) U.S. Cl.
CPC ..... *G03G 21/1647* (2013.01); *G03G 15/0886* (2013.01)

(58) Field of Classification Search
CPC ..... G03G 15/0865; G03G 15/0886
USPC ..... 399/262
See application file for complete search history.

(56) References Cited

U.S. PATENT DOCUMENTS

| | | | | |
|---|---|---|---|---|
| 6,185,401 | B1 * | 2/2001 | Kanamori et al. | 399/262 |
| 2005/0169672 | A1 * | 8/2005 | Ban et al. | 399/258 |
| 2006/0104673 | A1 | 5/2006 | Sasae et al. | |
| 2008/0213004 | A1 | 9/2008 | Sasae et al. | |
| 2010/0158575 | A1 | 6/2010 | Maeshima et al. | |
| 2010/0239325 | A1 | 9/2010 | Asai | |
| 2014/0064781 | A1 * | 3/2014 | Hashimoto | G03G 21/1666 399/110 |

FOREIGN PATENT DOCUMENTS

| | | | |
|---|---|---|---|
| EP | 1895368 | A2 | 3/2008 |
| JP | 2003107892 | A | 4/2003 |
| JP | 2005114935 | A | 4/2005 |
| JP | 2006139070 | A | 6/2006 |
| JP | 2010170101 | A | 8/2010 |

OTHER PUBLICATIONS

European Patent Office, Extended European Search Report Issued in European Patent Application No. 14176422.5, Feb. 3, 2015, Germany, 6 pages.

* cited by examiner

*Primary Examiner* — Walter L Lindsay, Jr.
*Assistant Examiner* — Philip Marcus T Fadul
(74) *Attorney, Agent, or Firm* — Alleman Hall McCoy Russell & Tuttle LLP

(57) ABSTRACT

An apparatus body of an image forming apparatus is provided with a drive transmission mechanism including a first rotation portion and a second rotation portion. An operation portion of a toner container includes a first connection portion to be connected to the first rotation portion. An opening and closing mechanism of the toner container includes a second connection portion to be connected to the second rotation portion. The opening and closing mechanism opens and closes a toner outlet by the second connection portion being rotated.

5 Claims, 19 Drawing Sheets

TONER CONTAINER AND IMAGE FORMING APPARATUS INCLUDING THE TONER CONTAINER

INCORPORATION BY REFERENCE

This application is based upon and claims the benefit of priority from the corresponding Japanese Patent Application No. 2013-147037 filed on Jul. 12, 2013, the entire contents of which are incorporated herein by reference.

BACKGROUND

The present disclosure relates to a toner container and an image forming apparatus including the toner container.

An image forming apparatus such as a copy machine or a laser printer includes a toner container mounted on an apparatus body thereof. In general, such a toner container includes a casing that contains toner, a toner outlet formed in the casing, and a shutter mechanism for opening and closing the toner outlet. The toner container includes a lever for causing the shutter mechanism to operate.

In the image forming apparatus of this type, depending on the specification of image quality, the destination, the color of image, or the like, different types of toners are used. Therefore, usually, for the image forming apparatus, applicable toners are specified.

When a user uses a not-specified toner in the image forming apparatus by mistake, there is a risk of causing malfunction of the image forming apparatus, a poor printed image, and the like. Therefore, it is necessary to eliminate compatibility of toner containers each containing toner with a plurality of models of the image forming apparatus (hereinafter, referred to as a toner container having an incompatibility function).

It is known to form, in each toner container, a model identification projection whose shape and position are different for each model of the image forming apparatus, and at the same time, to form, in the apparatus body to which the toner container is mounted, a recess to be engaged with the above projection.

However, in general, the above projection is formed from a resin material, similarly to the body of the toner container. Thus, the projection can be easily cut out with a knife or the like. As a result, the toner container from which the projection has been cut out becomes able to be mounted to an image forming apparatus to which the toner container should not have been able to be properly mounted.

In contrast, there is also known a toner container having a projecting step portion formed on an upper portion thereof, the step portion extending along an insertion direction of the toner container into the apparatus body. Inside the step portion of this toner container, a void is provided which communicates with the interior of the toner container. Thus, the toner container is configured such that when the step portion is cut out, toner inside the toner container leaks, thereby to prevent the step portion from being cut out.

SUMMARY

An image forming apparatus according to one aspect of the present disclosure includes an apparatus body, a toner container, and a drive transmission mechanism. The toner container is configured to be mounted to the apparatus body. The drive transmission mechanism is provided in the apparatus body. The toner container includes a casing configured to contain toner, a toner outlet formed in the casing, an opening and closing mechanism provided in the casing and configured to open and close the toner outlet, and an operation portion provided in the casing. The drive transmission mechanism includes a first rotation portion, and a second rotation portion configured to rotate in conjunction with the first rotation portion. The operation portion includes a first connection portion. The first connection portion is configured to rotate by the operation portion being operated, and configured to be connected to the first rotation portion of the drive transmission mechanism so as to be rotatable integrally with the first rotation portion, by the toner container being mounted to the apparatus body. The opening and closing mechanism includes a second connection portion. The second connection portion is configured to be connected to the second rotation portion of the drive transmission mechanism so as to be rotatable integrally with the second rotation portion, by the toner container being mounted to the apparatus body. The opening and closing mechanism is configured to open and close the toner outlet by the second connection portion being rotated.

A toner container according to another aspect of the present disclosure includes a casing, a toner outlet, an opening and closing mechanism, and an operation portion. The casing is configured to be mounted to an apparatus body of an image forming apparatus, and configured to be able to contain toner. The toner outlet is formed in the casing. The opening and closing mechanism is provided in the casing and configured to open and close the toner outlet. The operation portion is provided in the casing. The apparatus body is provided with a drive transmission mechanism including a first rotation portion and a second rotation portion configured to rotate in conjunction with the first rotation portion. The operation portion includes a first connection portion. The first connection portion is configured to rotate by the operation portion being operated, and configured to be connected to the first rotation portion of the drive transmission mechanism so as to be rotatable integrally with the first rotation portion, by the casing being mounted to the apparatus body. The opening and closing mechanism includes a second connection portion. The second connection portion is configured to be connected to the second rotation portion of the drive transmission mechanism so as to be rotatable integrally with the second rotation portion, by the casing being mounted to the apparatus body. The opening and closing mechanism is configured to open and close the toner outlet by the second connection portion being rotated.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described in detail with reference to the drawings. It should be noted that the present disclosure is not limited to the following embodiments.

<Image Forming Apparatus>

Figure 1:
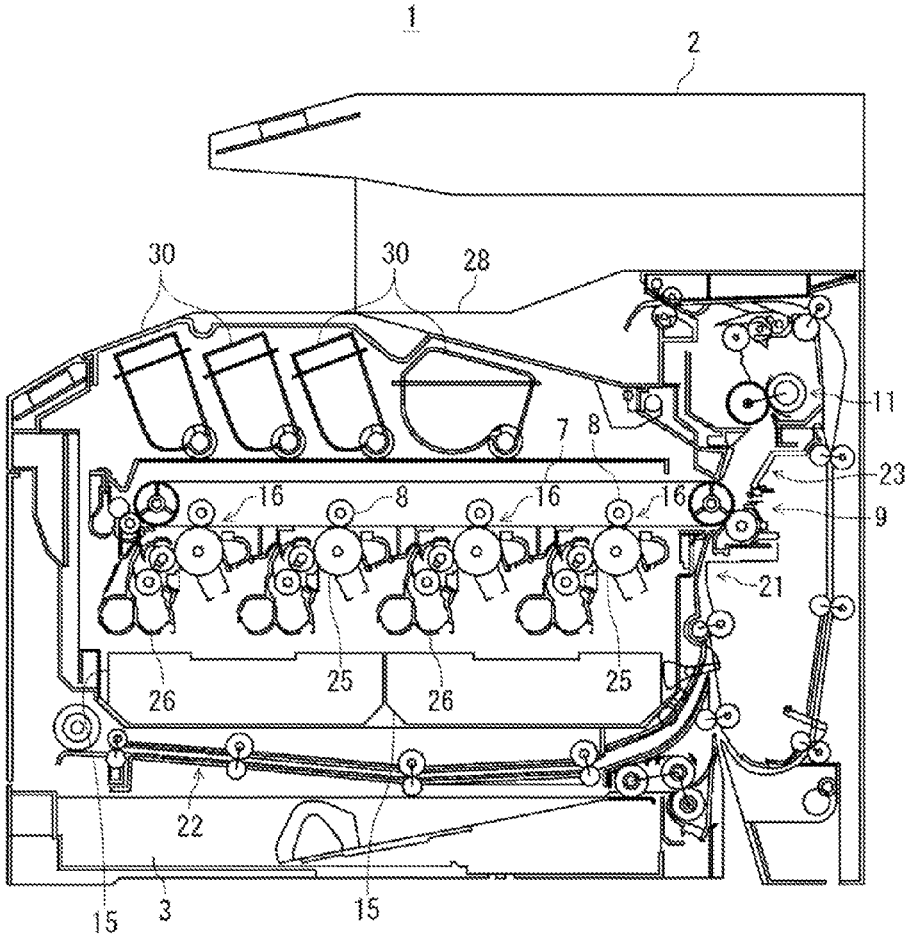
FIG. 1 is a cross-sectional view showing a structure of a laser printer as an image forming apparatus according to the present embodiment.

FIG. 1 is a cross-sectional view showing a structure of an image forming apparatus 1. The image forming apparatus 1 is, for example, a tandem-type color printer. As shown in FIG. 1, the image forming apparatus 1 includes an apparatus body 2, and toner containers 30 mounted to the apparatus body. The apparatus body 2 includes an intermediate transfer belt 7, primary transfer portions 8, a secondary transfer portion 9, a fixing device 11, laser scanning units 15, and a plurality of image forming portions 16.

In a lower part inside the apparatus body 2 of the image forming apparatus 1, a sheet feed cassette 3 is arranged. The sheet feed cassette 3 contains sheets (not shown), in a stack, such as paper sheets before being subjected to printing. Laterally to the sheet feed cassette 3, a first paper sheet conveying portion 21 extending upward is provided. The first paper sheet conveying portion 21 receives a paper sheet sent out from the sheet feed cassette 3 and conveys the paper sheet to the secondary transfer portion 9 provided thereabove. Above the sheet feed cassette 3, a second paper sheet conveying portion 22 is provided. The second paper sheet conveying portion 22 receives a paper sheet or the like sent out from a manual sheet feed portion (not shown) and conveys it to the first paper sheet conveying portion 21.

The laser scanning units 15 are arranged above the second paper sheet conveying portion 22. Each laser scanning unit 15 irradiates the image forming portions 16 with laser light based on image data received by the image forming apparatus 1. In the apparatus body 2, two laser scanning units 15 each irradiating two image forming portions 16 with laser light are arranged side by side. Four image forming portions 16 are arranged above the laser scanning units 15. Above the image forming portions 16, the intermediate transfer belt 7 being an endless belt is provided. The intermediate transfer belt 7 is wound around a plurality of rollers and is driven to rotate by a driving device not shown.

The four image forming portions 16 are arranged in a line along the intermediate transfer belt 7 as shown in FIG. 1, and form toner images of yellow, magenta, cyan, and black, respectively. Each image forming portion 16 includes a photosensitive drum 25 being a photoreceptor, and a developing device 26 arranged around the photosensitive drum 25. In each image forming portion 16, an electrostatic latent image of a document image is formed on the photosensitive drum 25 with laser light emitted by the laser scanning unit 15. Then, this electrostatic latent image is developed by the developing device 26, whereby a toner image of its corresponding color is formed.

The toner containers 30 are arranged above the intermediate transfer belt 7. The toner containers 30 containing yellow, magenta, cyan, and black toners, respectively, are arranged in a line along the intermediate transfer belt 7. Each toner container 30 is configured to supply toner to a developing device of a color corresponding thereto.

The primary transfer portions 8 are arranged above the image forming portions 16, respectively. Each primary transfer portion 8 has a transfer roller which primarily transfers the toner image formed in the image forming portion 16, onto the surface of the intermediate transfer belt 7.

While the intermediate transfer belt 7 is driven to rotate, the toner image of each image forming portion 16 is transferred to the intermediate transfer belt 7 at a predetermined timing. Accordingly, on the surface of the intermediate transfer belt 7, a color toner image is formed in which toner images of four colors, i.e., yellow, magenta, cyan, and black, are superimposed.

The secondary transfer portion 9 applies a transfer bias voltage having a polarity opposite to that of the toners, to a paper sheet having been sent from the first paper sheet conveying portion 21. Accordingly, the toner image is transferred from the intermediate transfer belt 7 to the paper sheet.

The fixing device 11 is provided above the secondary transfer portion 9. Between the secondary transfer portion 9 and the fixing device 11, a third paper sheet conveying portion 23 is formed which conveys, to the fixing device 11, the paper sheet on which the toner image has been secondarily transferred. The fixing device 11 heats and pressurizes the paper sheet having been conveyed from the third paper sheet conveying portion 23, to fix the toner image onto the paper sheet. The paper sheet having been discharged from the fixing device 11 is discharged into a paper sheet discharge portion 28 formed in an upper portion of the apparatus body 2.

<Toner Container>

FIG. 2 to FIG. 8 show structures of the toner container 30 according to the present embodiment.

Figure 2:
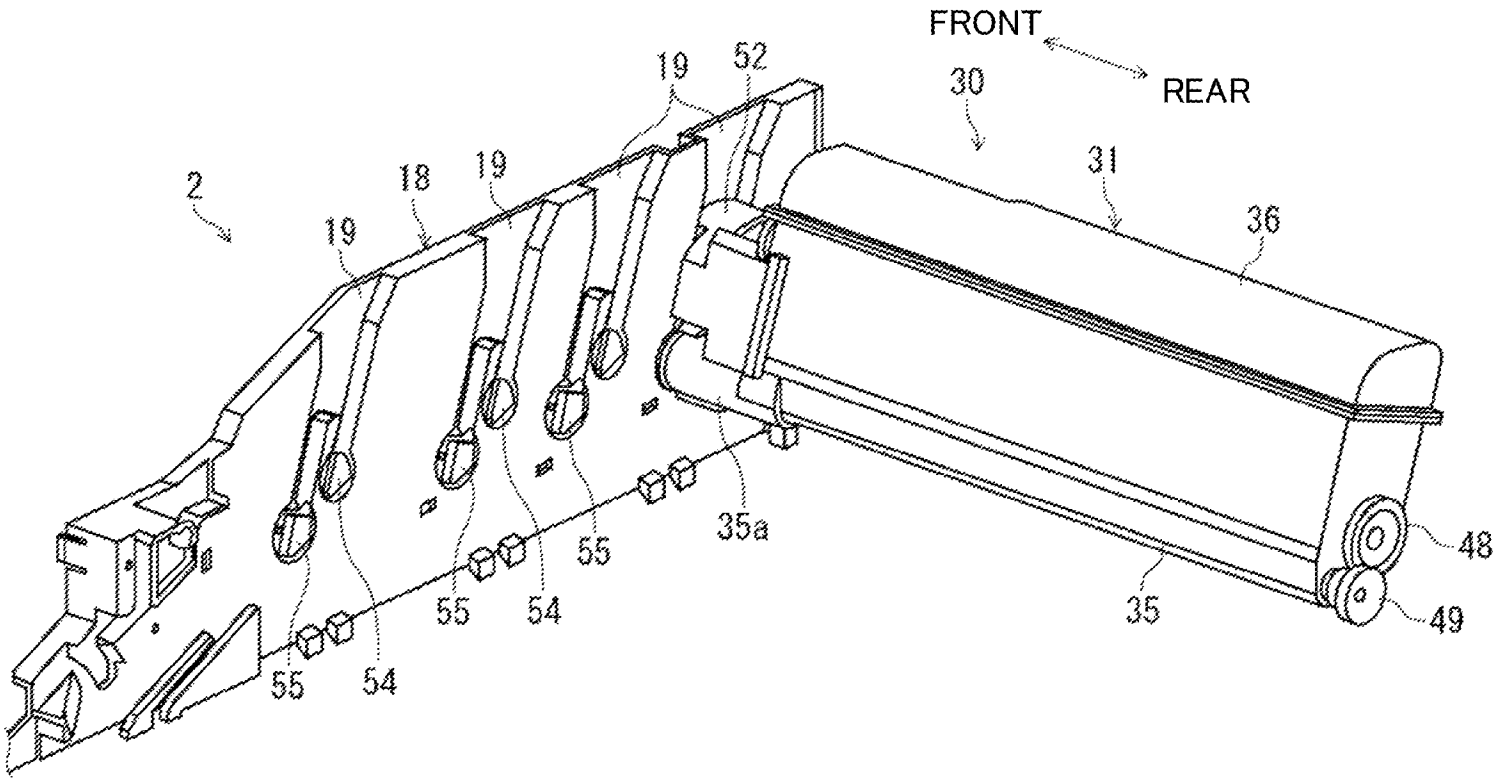
FIG. 2 is a perspective showing a toner container along with a mount portion therefor.
Figure 3:
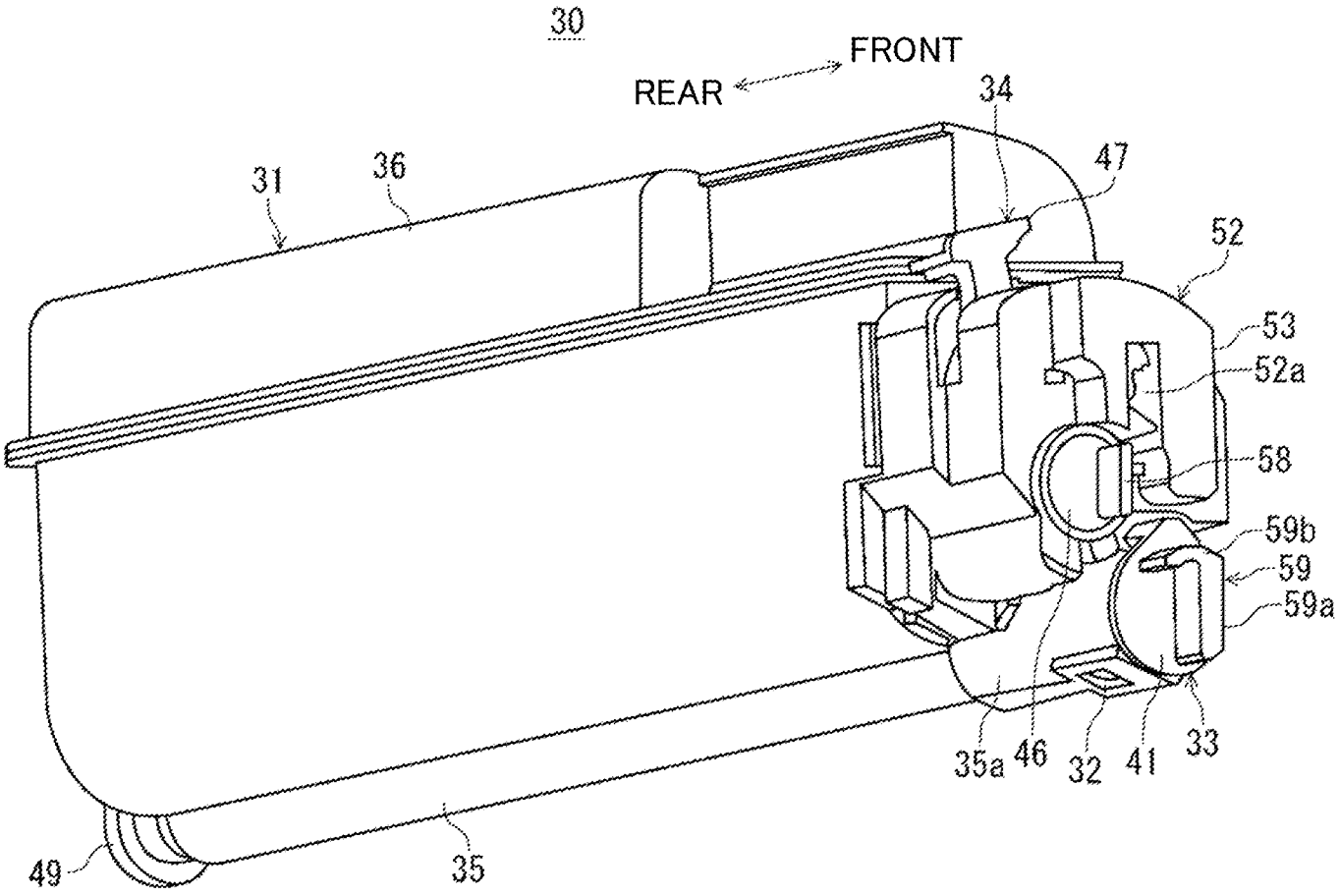
FIG. 3 is a perspective showing an external view of the toner container.
Figure 4:
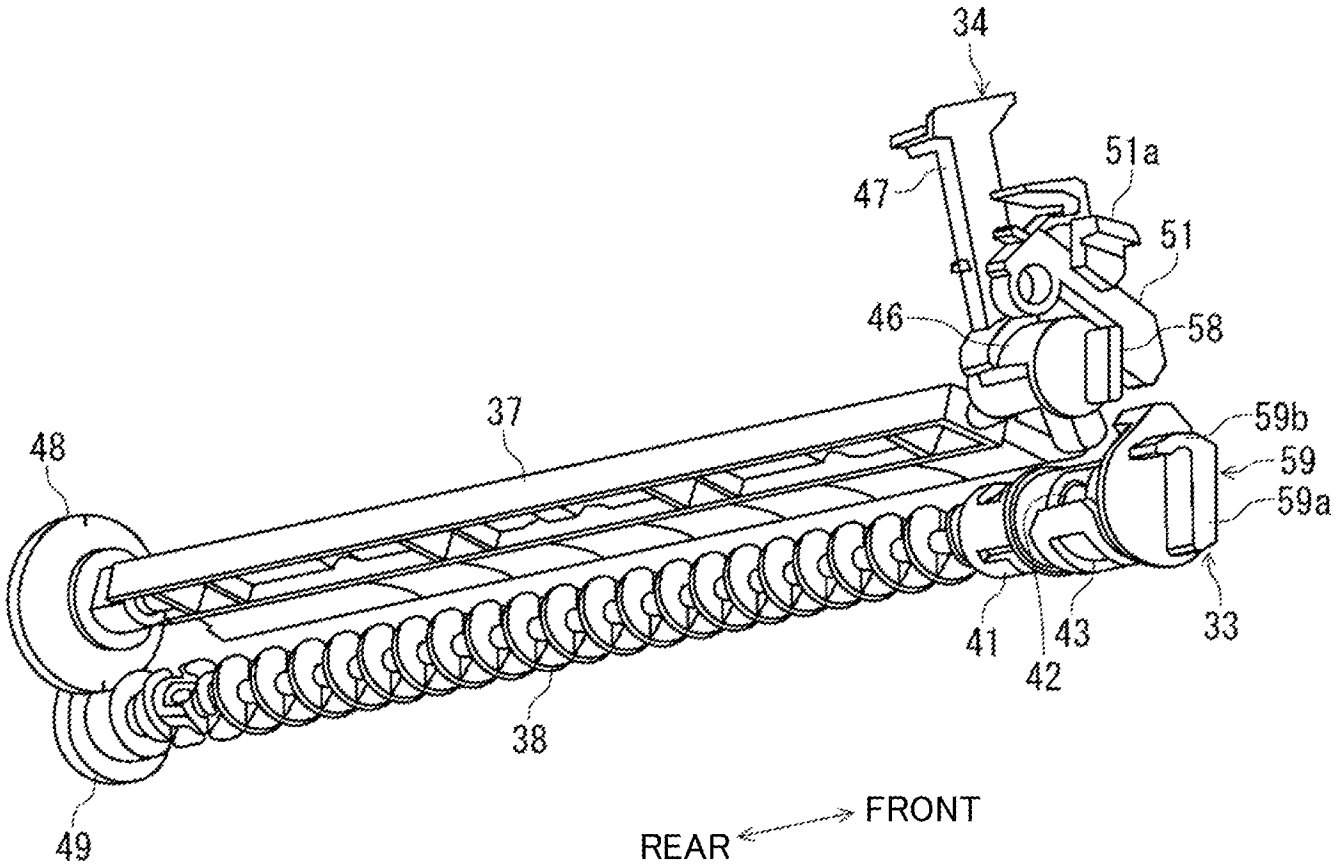
FIG. 4 is a perspective showing a lever, a shutter mechanism, an agitation mechanism and a screw portion.

As shown in FIG. 2 to FIG. 4, the toner container 30 includes a casing 31, a toner outlet 32, an opening and closing mechanism 33, and an operation portion 34. The casing 31 is configured to be mounted to the apparatus body 2 of the image forming apparatus 1 and configured to be able to contain toner. The toner outlet 32 is formed in the casing 31. The opening and closing mechanism 33 is provided in the casing 31, and configured to be able to open and close the toner outlet 32. The operation portion 34 is provided in the casing 31.

As shown in FIG. 2, the apparatus body 2 includes a mount portion 18 of a plate-like shape to which the casing 31 is mounted. On one surface of the mount portion 18, a plurality of container guides 19 each having a groove-like shape and extending diagonally upward are formed. The casing 31 is guided diagonally downward by a corresponding container guide 19, to be mounted to the mount portion 18.

The casing 31 is formed from a resin material and is formed in a box-like shape extending in a front-rear direction. Here, in FIG. 2 to FIG. 5, the longitudinal direction of the casing 31 is defined as the front-rear direction. Moreover, the right side in FIG. 3 is defined as the front side of the casing 31, and the left side in FIG. 3 is defined as the rear side of the casing 31.

As shown in FIG. 3, the casing 31 includes a container body 35 and a lid portion 36. The container body 35 has a shape that has an open top and a closed bottom. The lid portion 36 closes the open top portion of the container body 35. Inside the container body 35, as shown in FIG. 4, an agitation paddle 37 which agitates toner and a screw portion 38 which conveys the toner to the toner outlet 32 are provided.

Figure 5:
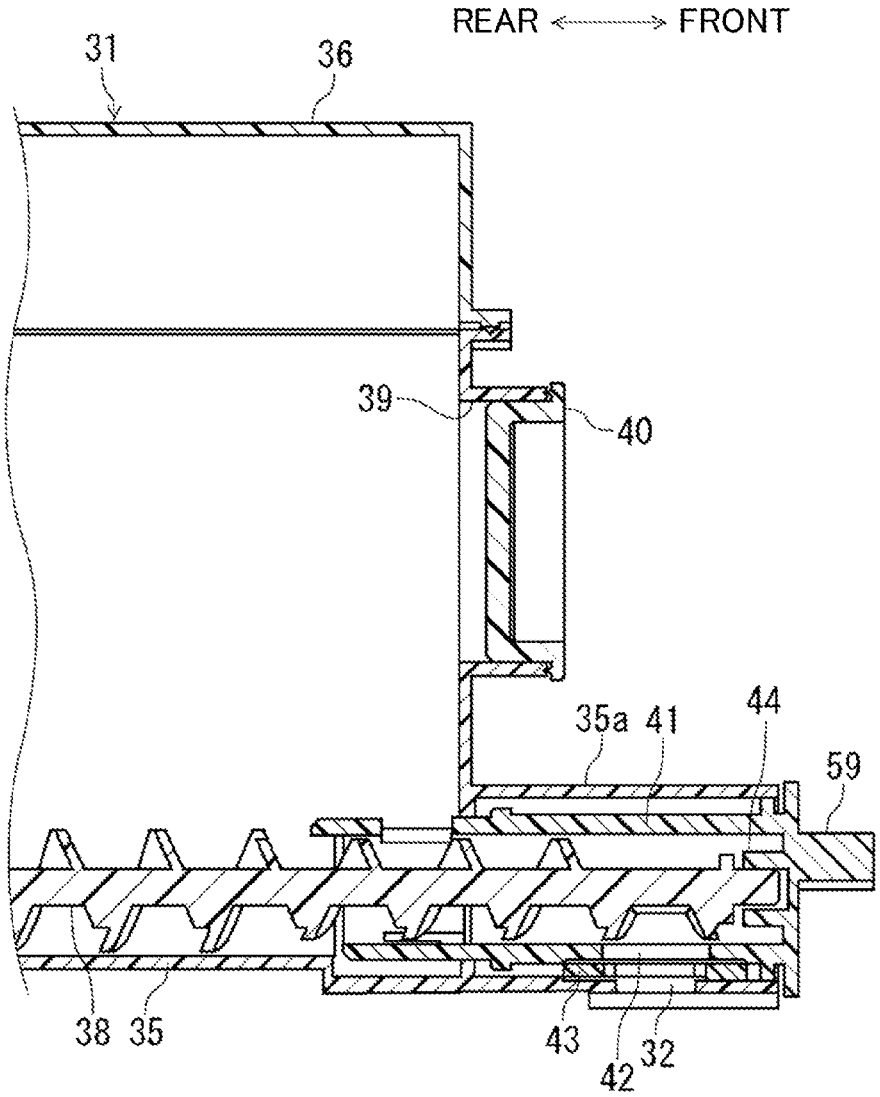
FIG. 5 is a cross-sectional view showing a structure of the shutter mechanism.

As shown in FIG. 5, to a wall on the front side of the container body 35, a toner filling opening 39 is provided. The toner filling opening 39 is used in order to fill the casing 31 with toner. The toner filling opening 39 is closed with a plug member 40.

As shown in FIG. 3 and FIG. 5, the toner outlet 32 is formed on the front end side of the bottom of the container body 35. In a front end portion of the container body 35, a protruding portion 35*a* is formed which has a substantially cylindrical shape and extends so as to protrude forward. The toner outlet 32 is formed so as to extend downward penetrating through the peripheral wall of the protruding portion 35*a*.

As shown in FIG. 4 and FIG. 5, the opening and closing mechanism 33 includes a shutter cylinder 41, an opening 42, and a seal member 43. The shutter cylinder 41 is formed in a cylindrical shape having a closed front end, and is inserted into the protruding portion 35*a* of the container body 35. The opening 42 is formed in a side face of the shutter cylinder 41. The seal member 43 is provided around the toner outlet 32 in the inner wall of the protruding portion 35*a*.

Inside a front end portion of the shutter cylinder 41, a bearing 44 which rotatably supports the screw portion 38 is formed. The seal member 43 prevents toner from scattering.

The shutter cylinder 41 is rotatably mounted to the protruding portion 35*a*. When the shutter cylinder 41 rotates and the opening 42 of the shutter cylinder 41 overlaps the toner outlet 32, the toner outlet 32 is opened, and the toner in the casing 31 can be discharged from the toner outlet 32 to the developing device 26. On the other hand, when a peripheral wall portion, of the shutter cylinder 41, where the opening 42 is not formed overlaps the toner outlet 32, the toner outlet 32 is closed. That is, the toner outlet 32 is opened and closed in accordance with rotation of the shutter cylinder 41.

Figure 7:
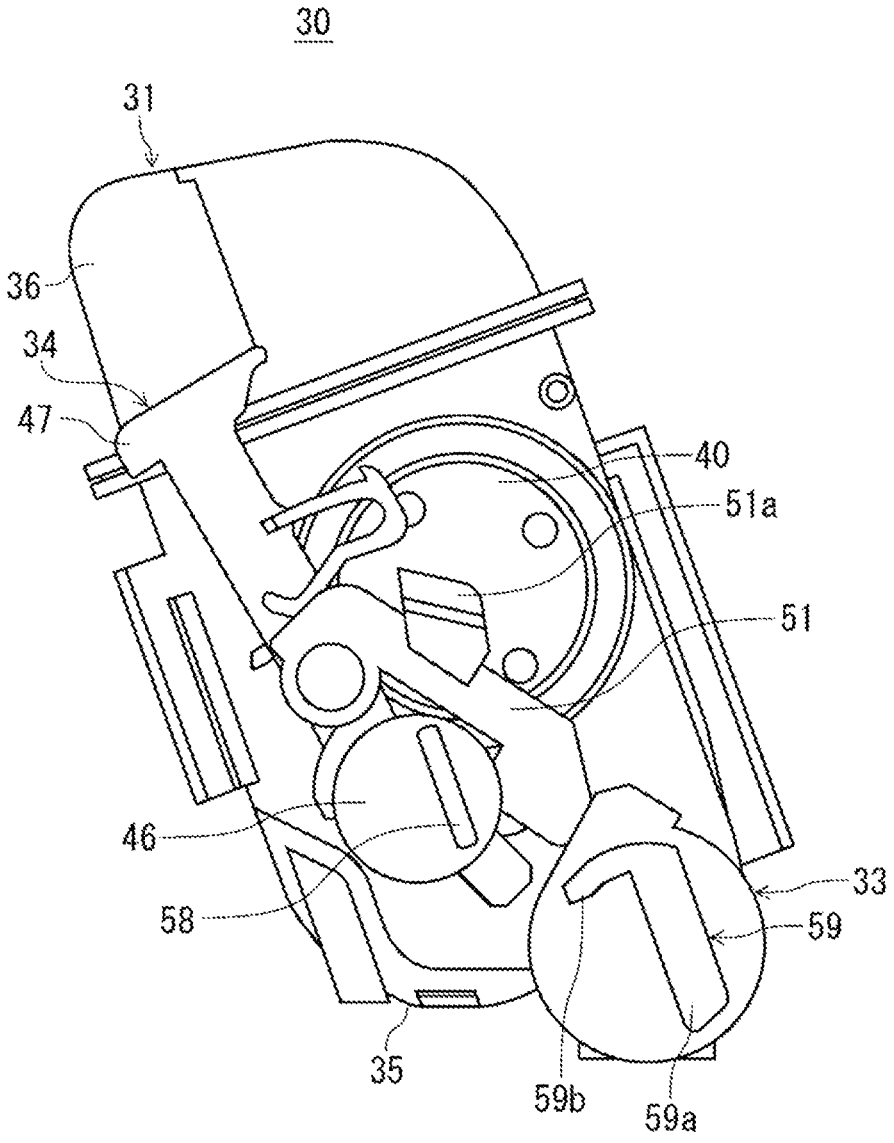
FIG. 7 is a front view showing a toner container with a cover member removed.

As shown in FIG. 7, the operation portion 34 is provided in the front end portion of the container body 35. The operation portion 34 includes a shaft portion 46 rotatably supported by the container body 35, and a lever 47 fixed to the shaft portion 46.

The axis of the shaft portion 46 extends in the front-rear direction. The lever 47 is capable of swinging integrally with the shaft portion 46 about the axis of the shaft portion 46. As shown in FIG. 4, the front end of the agitation paddle 37 is rotatably supported inside the shaft portion 46. On the other hand, to the rear end of the agitation paddle 37, an agitation gear 48 is connected. Moreover, to the rear end of the screw portion 38, a drive gear 49 is connected. As shown in FIG. 2, the agitation gear 48 and the drive gear 49 are arranged in a rear end portion of the container body 35.

In the front end portion of the container body 35, a lock member 51 is provided. The lock member 51 puts the operation portion 34 and the opening and closing mechanism 33 into a locked state so as to prevent erroneous operation thereof. That is, the lock member 51 puts the operation portion 34 into a locked state so as to restrict operation of the operation portion 34. Further, the lock member 51 puts the opening and closing mechanism 33 into a locked state so as to restrict opening and closing operation of the opening and closing mechanism 33. In the lock member 51, a claw portion 51*a* protruding forward is formed integrally therewith.

In a locked state of the operation portion 34 and the opening and closing mechanism 33, a lower portion of the lock member 51 is sandwiched by a projection 46*a* formed integrally with the shaft portion 46 and a projection 41*a* formed integrally with the shutter cylinder 41. As a result, the lock member 51 does not allow the shaft portion 46 to rotate in the clockwise direction in FIG. 8, and does not allow the shutter cylinder 41 to rotate in the anticlockwise direction in FIG. 8. The lock member 51 is configured to release the locked state of the operation portion 34 and the opening and closing mechanism 33, by sliding upward in FIG. 8.

Figure 6:
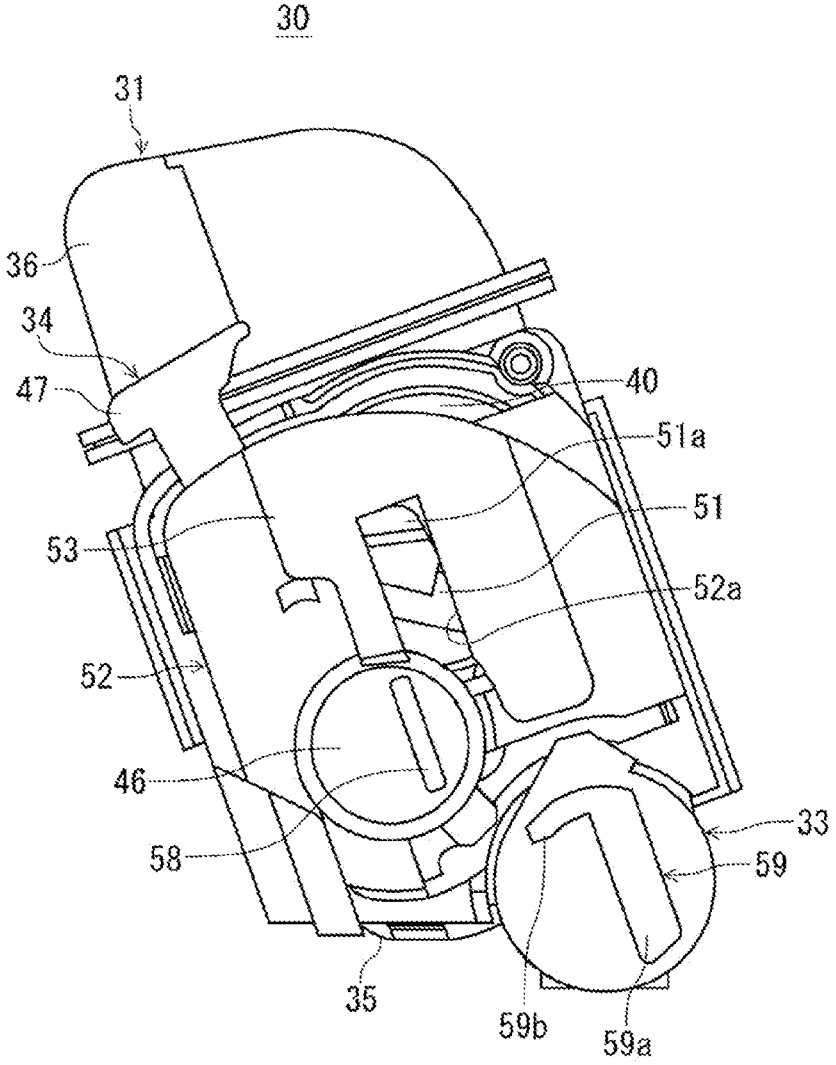
FIG. 6 is a front view showing an external view of the toner container.

Further, as shown in FIG. 3 and FIG. 6, to the front end portion of the container body 35, a cover member 52 is mounted which covers the proximal end side of the lever 47 and the lock member 51. The cover member 52 includes a positioning protrusion 53 having a block shape protruding forward. In the positioning protrusion 53, a slit 52*a* is formed which extends in the up-down direction and which is open at a lower end thereof. That is, since the slit 52*a* is formed in the cover member 52, the cover member 52 is forked into two. The claw portion 51*a* of the lock member 51 is exposed in the slit 52*a* from the cover member 52.

The positioning protrusion 53 has substantially the same width as the groove width of each container guide 19. As shown in FIG. 2, the positioning protrusion 53 is fitted into the container guide 19 to be guided diagonally downward by the container guide 19, whereby the casing 31 is mounted to the mount portion 18.

Figure 9:
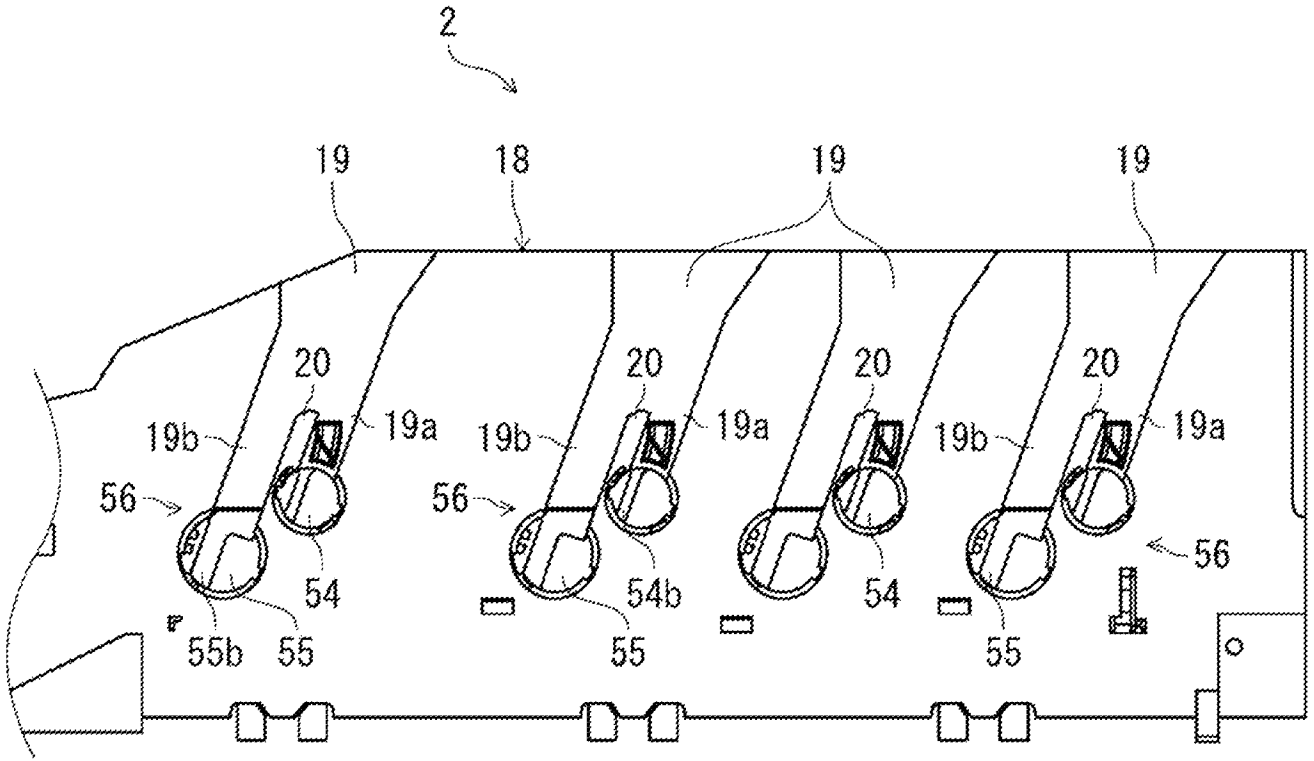
FIG. 9 is a back side view showing an external view of the mount portion.
Figure 10:
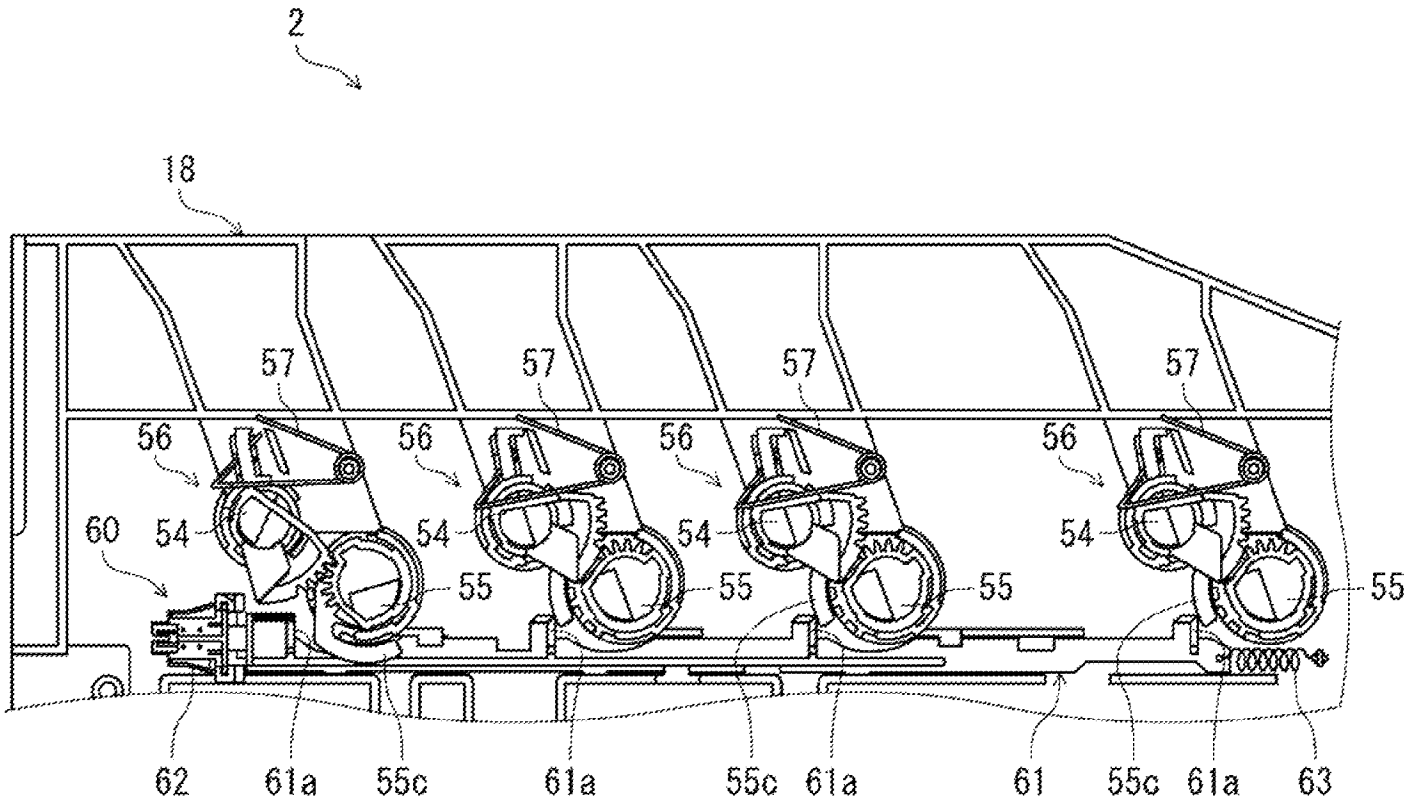
FIG. 10 is a front view showing the mount portion with one toner container mounted thereto.
Figure 11:
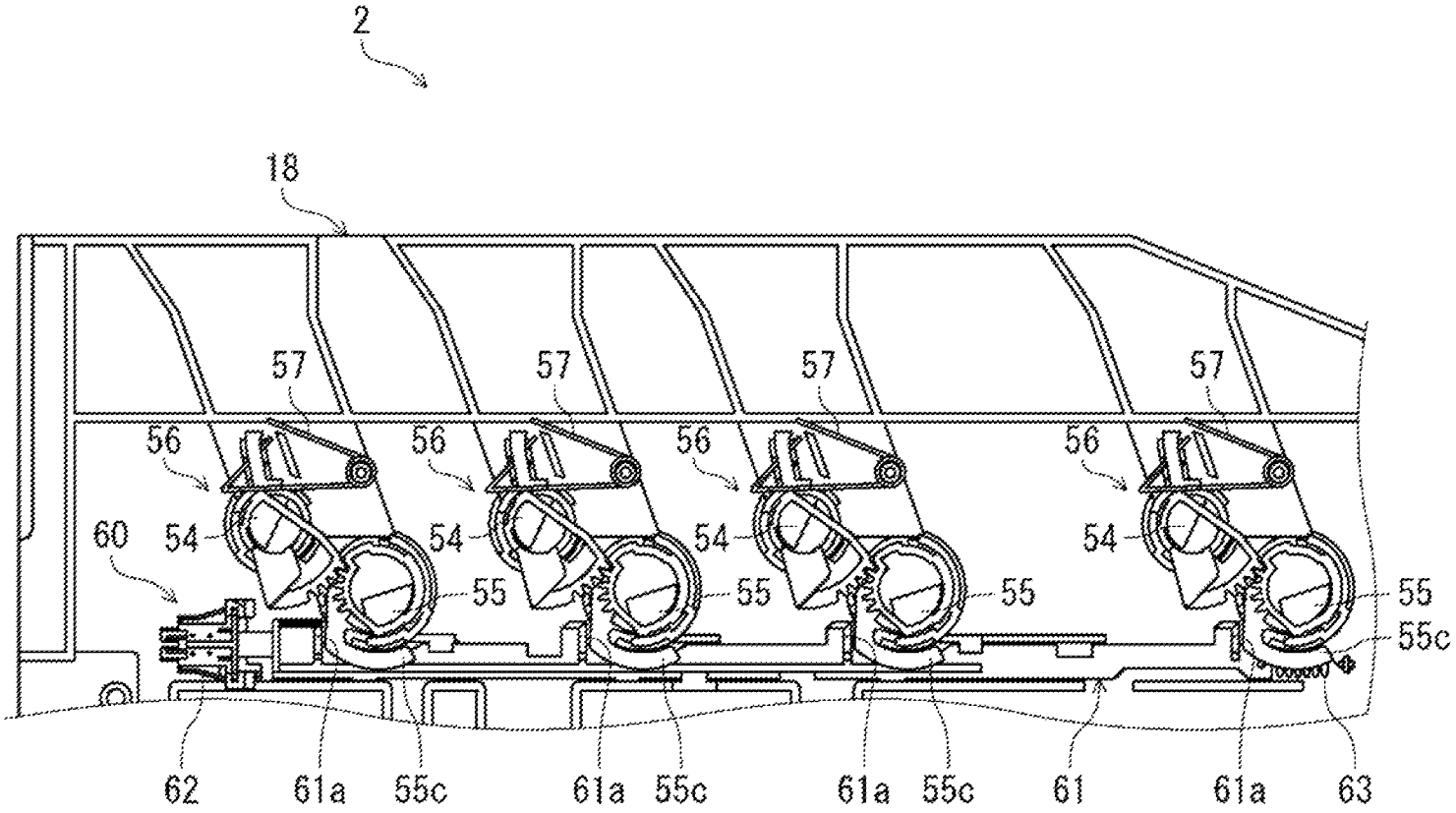
FIG. 11 is a front view showing the mount portion having four toner containers mounted thereto.
Figure 12:
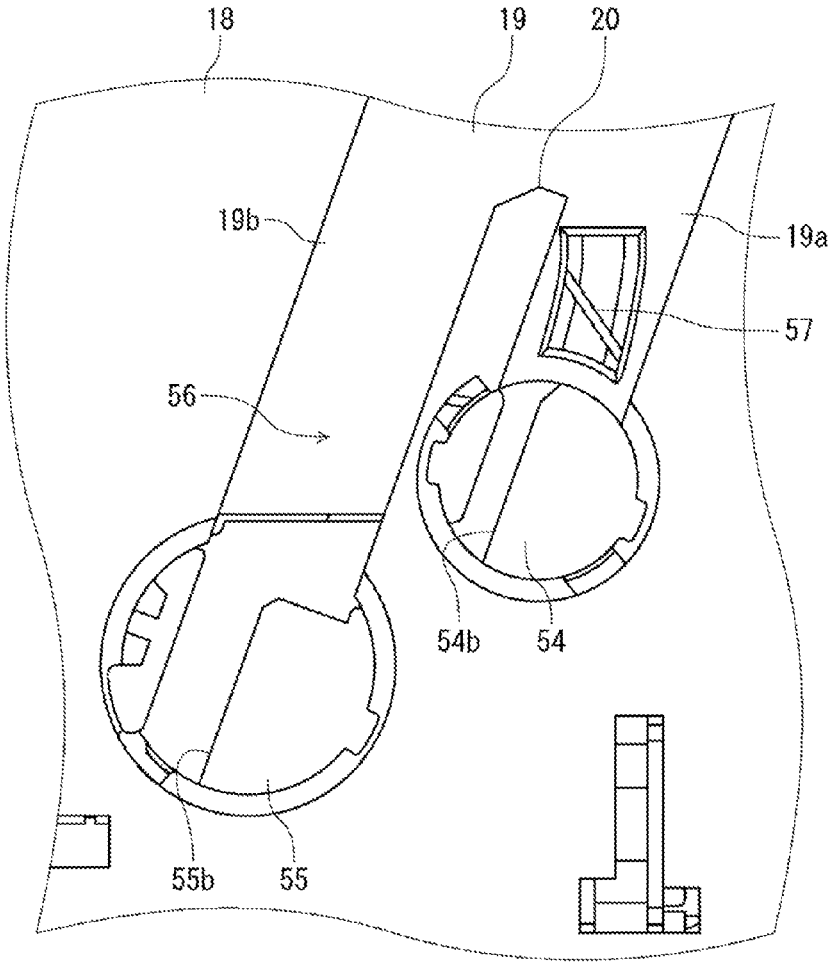
FIG. 12 is an enlarged back side view of a drive transmission mechanism.
Figure 13:
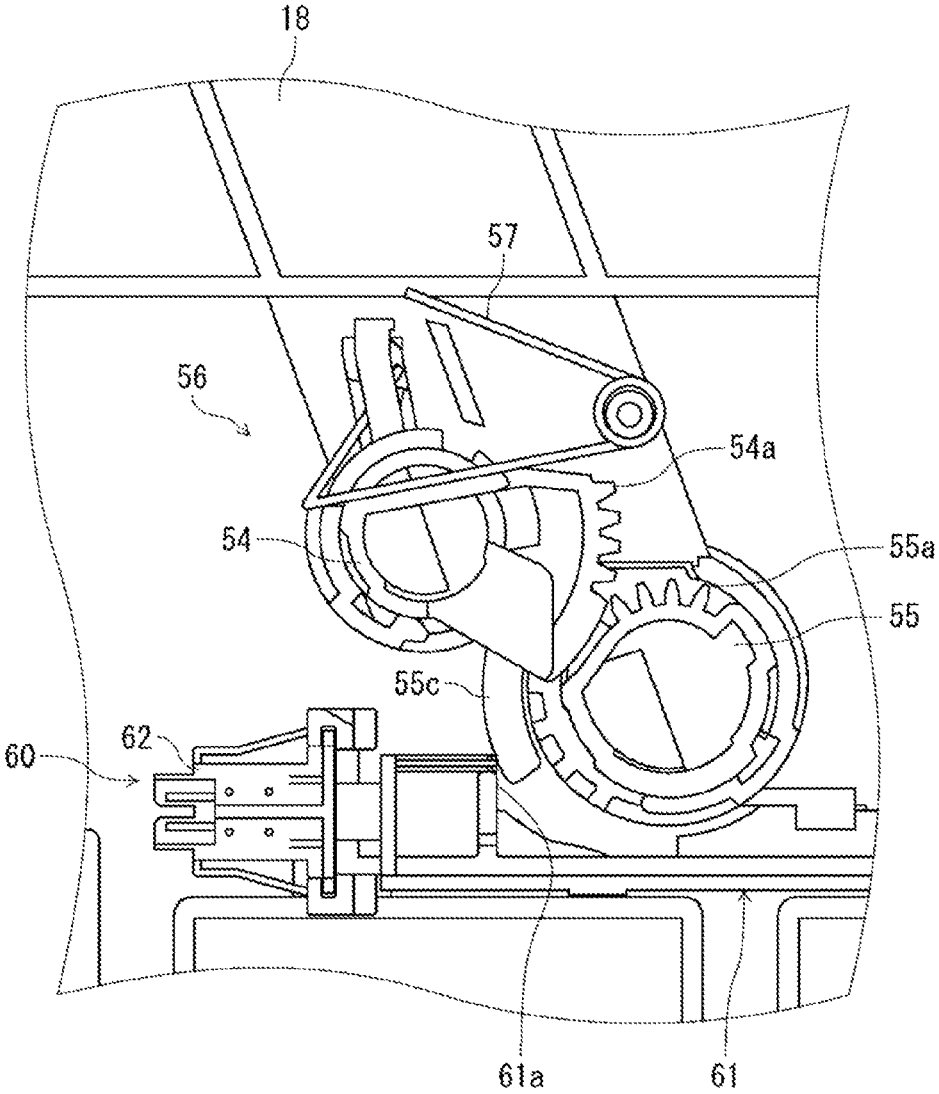
FIG. 13 is an enlarged front view of the drive transmission mechanism.
Figure 14:
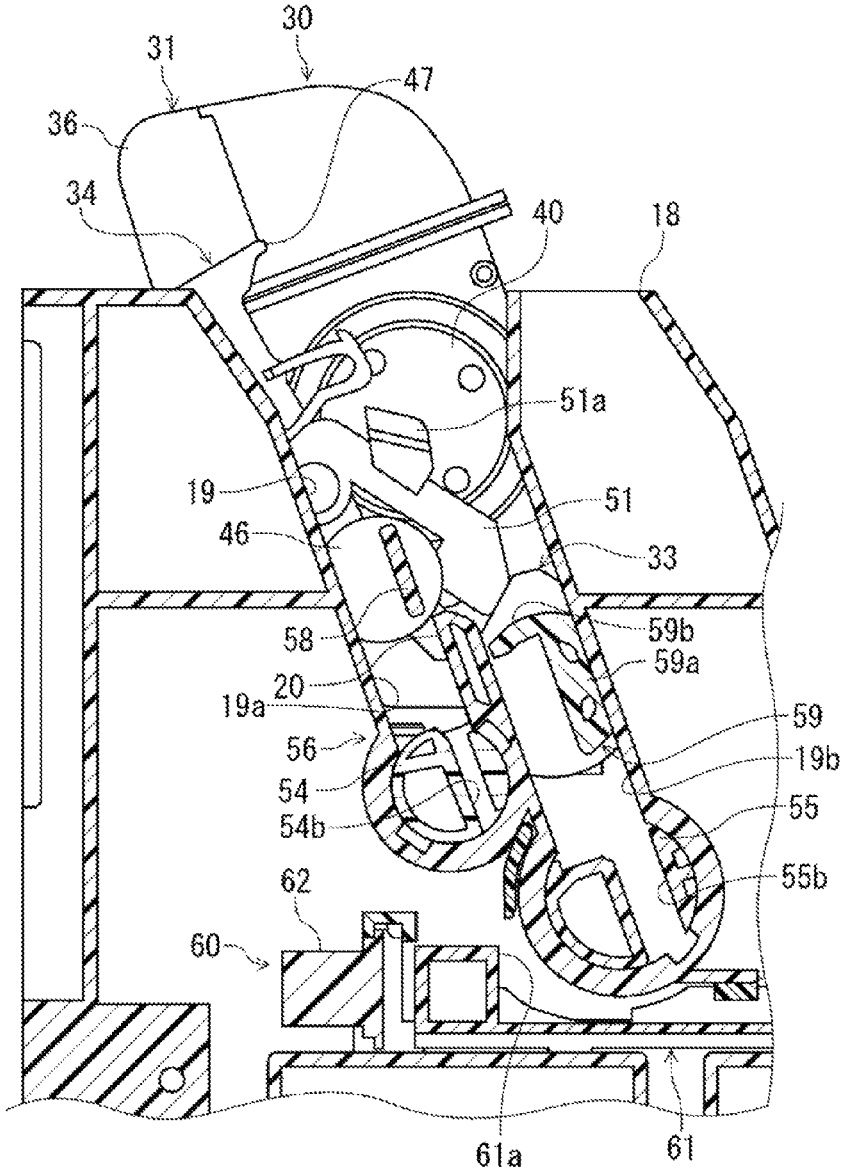
FIG. 14 is a front view, partially broken away, of the toner container mounted to the mount portion.
Figure 15:
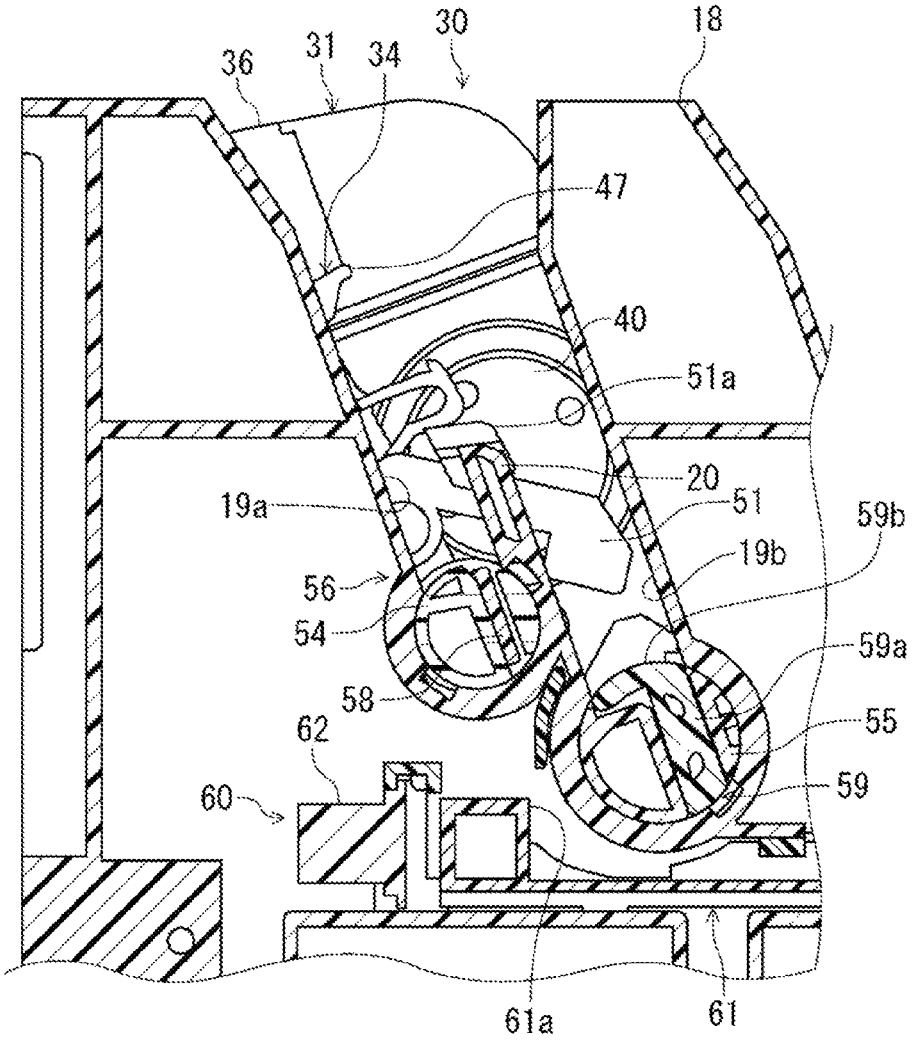
FIG. 15 is a front view, partially broken away, of the toner container mounted to the mount portion with a lock member released.
Figure 16:
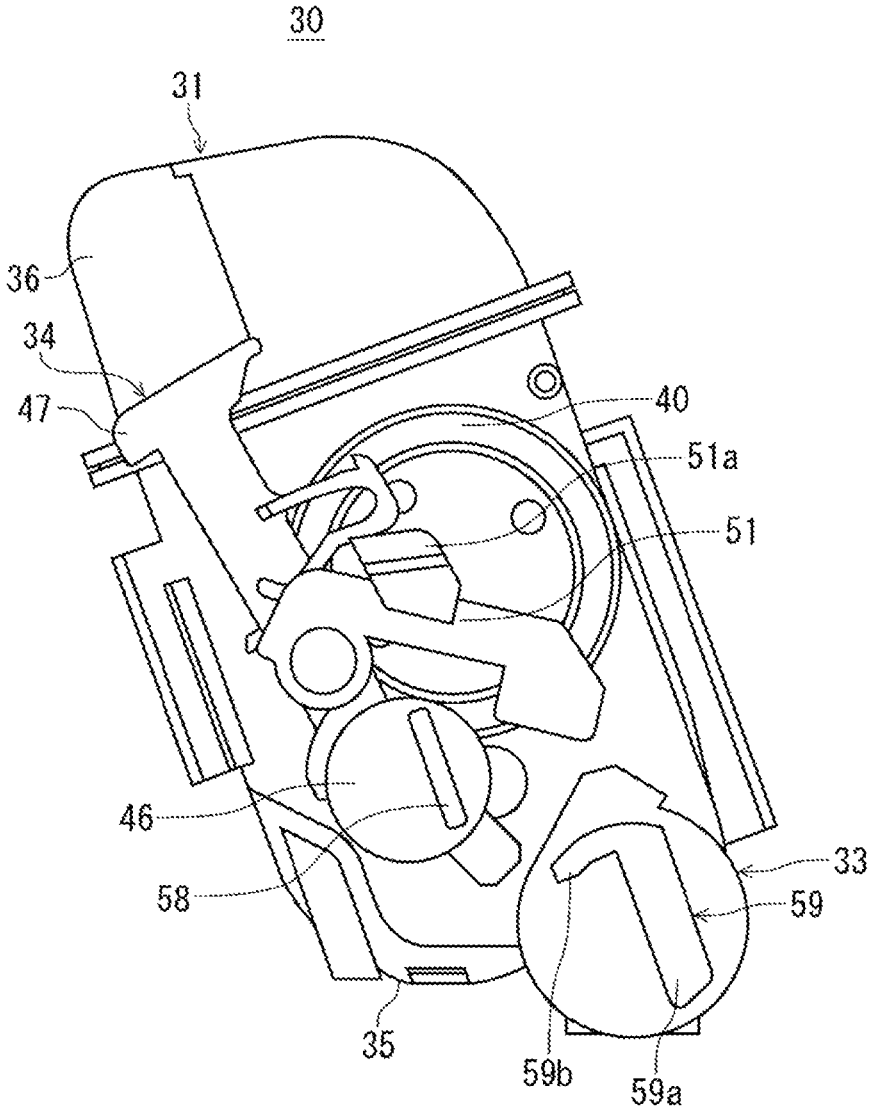
FIG. 16 is a front view showing the toner container with the lock member released.

FIG. 9 to FIG. 11 each show an external view of the mount portion 18. FIG. 12 and FIG. 13 are each an enlarged view of a drive transmission mechanism 56. FIG. 14 to FIG. 16 each show operation of the lock member 51 when the locked state of the operation portion 34 and the opening and closing mechanism 33 is released. In FIG. 14 to FIG. 16, the cover member 52 is not shown for explanation.

As shown in FIG. 9 and FIG. 12, a lower portion of each container guide 19 in the mount portion 18 is forked into two, i.e., a first groove portion 19*a* and a second groove portion 19*b*, such that the two forks of the cover member 52 can be mounted thereinto. Between the first groove portion 19*a* and the second groove portion 19*b*, a protrusion 20 is formed which extends along the first and second groove portions 19*a* and 19*b*.

When the cover member 52 is guided by the container guide 19 in a diagonally downward mounting direction, the protrusion 20 is inserted into the slit 52*a* of the cover member 52. Then, as shown in FIG. 14 to FIG. 16, the upper end of the protrusion 20 comes into contact with the claw portion 51*a* of the lock member 51, to push up the lock member 51. Thus, the lock member 51 is configured to, when the toner container 30 is mounted to the mount portion 18, come into contact with the protrusion 20 to release the locked state of the operation portion 34 and the opening and closing mechanism 33 by the lock member 51.

As shown in FIG. 9 to FIG. 13, the apparatus body 2 is provided with the drive transmission mechanisms 56 each including a first rotation portion 54 and a second rotation portion 55 which rotates in conjunction with the first rotation portion 54. Four drive transmission mechanisms 56 are provided in a line in the mount portion 18, corresponding to the four toner containers 30.

The first rotation portion 54 is arranged at the lower end of the first groove portion 19*a* in the container guide 19, and is rotatably supported by the mount portion 18. On the other hand, the second rotation portion 55 is arranged at the lower end of the second groove portion 19*b*, and is rotatably supported by the mount portion 18.

The first rotation portion 54 includes a first gear portion 54*a*. The second rotation portion 55 includes a second gear portion 55*a* which is meshed with the first gear portion 54*a*. The first gear portion 54*a* is formed integrally with the first rotation portion 54. The second gear portion 55*a* is formed integrally with the second rotation portion 55. Accordingly, the second rotation portion 55 is configured to rotate in a direction reverse to the rotation direction of the first rotation portion 54. As shown in FIG. 13, the first and second gear portions 54*a* and 55*a* are arranged on the opposite side, of the mount portion 18, to the side where the container guide 19 is formed.

As described above, since the first rotation portion 54 includes the first gear portion 54*a* and the second rotation portion 55 includes the second gear portion 55*a*, the drive transmission mechanism 56 can have a simple structure, and at the same time, the rotation drive force of the lever 47 can be assuredly transmitted to the opening and closing mechanism 33.

With respect to the first gear portion 54*a* and the second gear portion 55*a*, the rotation angle of the second rotation portion 55 is set to be greater than the rotation angle of the first rotation portion 54. For example, when the first rotation portion 54 rotates by 45° along with the lever 47, the second rotation portion 55 rotates by 90°.

Further, as shown in FIG. 13, the mount portion 18 is provided with springs 57 as urging members. Each spring 57 urges the first rotation portion 54 in the anticlockwise direction in FIG. 13. Accordingly, the second rotation portion 55 is urged in the clockwise direction in FIG. 13 by the spring 57, via the first gear portion 54*a* and the second gear portion 55*a*.

On the other hand, as shown in FIG. 7, the operation portion 34 of the toner container 30 includes a first connection portion 58 which rotates by the operation portion 34 being operated. The first connection portion 58 is formed integrally with the front end of the shaft portion 46, and having a plate-like shape protruding forward. The first connection portion 58 extends in the mounting direction (i.e., diagonally downward) along which the cover member 52 is guided by the container guide 19 when the casing 31 is mounted to the mount portion 18.

As shown in FIG. 12, in the first rotation portion 54 of the drive transmission mechanism 56, a first connection groove 54*b* is formed into which the first connection portion 58 of the toner container 30 is connected. At least a portion of the first connection groove 54*b* linearly extends. On the other hand, the first connection portion 58 has a shape that fits into the first connection groove 54*b*. In other words, the first connection portion 58 is formed in a shape that can fit into the first connection groove 54*b*. That is, the width of the first connection groove 54*b* is substantially the same as the plate thickness of the first connection portion 58. By the casing 31 being mounted to the apparatus body 2, the first connection portion 58 is inserted into the first connection groove 54*b*, to be connected to the first rotation portion 54 so as to be rotatable integrally therewith.

As shown in FIG. 7, the opening and closing mechanism 33 of the toner container 30 includes a second connection portion 59 which rotates integrally with the shutter cylinder 41. The second connection portion 59 is formed integrally with the front end of the shutter cylinder 41 and protrudes forward. The cross section, of the second connection portion 59, orthogonal to the axial direction of the shutter cylinder 41 is a hook shape.

That is, the second connection portion 59 includes a first portion 59*a* and a second portion 59*b*. The first portion 59*a* extends in the mounting direction (i.e., diagonally downward) along which the cover member 52 is guided by the container guide 19 when the casing 31 is mounted to the mount portion 18. The second portion 59*b* extends, from the upper end of the first portion 59*a*, to one side in the rotation direction of the shutter cylinder 41. The plate thickness of the first portion 59*a* is greater than the plate thickness of the first connection portion 58.

As shown in FIG. 12, in the second rotation portion 55 of the drive transmission mechanism 56, a second connection groove 55*b* is formed into which the second connection portion 59 of the toner container 30 is connected. At least a portion of the second connection groove 55*b* linearly extends. On the other hand, the second connection portion 59 has a shape that fits into the second connection groove 55*b*. In other words, the second connection portion 59 is formed in a shape that can fit into the second connection groove 55*b*. That is, the width of the second connection groove 55*b* is substantially the same as the plate thickness of the first portion 59*a* in the second connection portion 59. Thus, the width of the second connection groove 55*b* is different from the width of the first connection groove 54*b*. By the casing 31 being mounted to the mount portion 18, the second connection portion 59 is inserted into the second connection groove 55*b*, to be connected to the second rotation portion 55 so as to be rotatable integrally therewith. Thus, by the second connection portion 59 being integrally rotated with the second rotation portion 55, the opening and closing mechanism 33 opens and closes the toner outlet 32.

Here, the at least a portion of each of the first connection groove 54*b* and the second connection groove 55*b* has a shape extending linearly. Thus, through operation of mounting the toner container 30 to the mount portion 18 along the container guide 19, the first connection portion 58 can be inserted into the first connection groove 54*b* to be connected thereto, and the second connection portion 59 can be inserted into the second connection groove 55*b* to be connected thereto.

The first connection portion 58 and the second connection portion 59 are configured to have incompatible shapes. An incompatible shape means a shape that allows mounting of the casing 31 to the apparatus body 2 of a specific model, but that does not allow mounting of the casing 31 to an apparatus body of a model other than the specific model. For example, depending on the model or the like of the image forming apparatus 1, the positions, the shapes, and the like of the first connection portion 58, the second connection portion 59, the first connection groove 54*b* of the first rotation portion 54, and the second connection groove 55*b* of the second rotation portion 55 are different.

As described above, the width of the first connection groove 54*b* and the width of the second connection groove 55*b* are different from each other. Thus, the number of combinations of the shape of the first connection groove 54*b* and the shape of the second connection groove 55*b* can be increased. Therefore, the pattern of an incompatible shape being the shape that exhibits an incompatibility function of the toner container 30 can be increased.

Moreover, as shown in FIG. 13, the second rotation portion 55 includes an arm 55*c* provided on the same side as the second gear portion 55*a* in the mount portion 18. The arm 55*c* is formed integrally with the second rotation portion 55 so as to extend to one side in the rotation direction of the second rotation portion 55. The arm 55*c* has a peripheral surface of an arc shape.

As shown in FIG. 10 and FIG. 11, the apparatus body 2 is provided with a detection portion 60. The detection portion 60 detects, with respect to the plurality of toner containers 30 mounted to the mount portion 18, whether all the toner outlets 32 are open. The detection portion 60 is arranged below the four drive transmission mechanisms 56. The detection portion 60 includes a detection bar 61 and a sensor 62. The detection bar 61 extends along the surface of the mount portion 18 in the direction along which the four drive transmission mechanisms 56 are arranged in a line. The sensor 62 is arranged at one end side of the detection bar 61. The other end of the detection bar 61 is connected to a tension spring 63.

Figure 19:
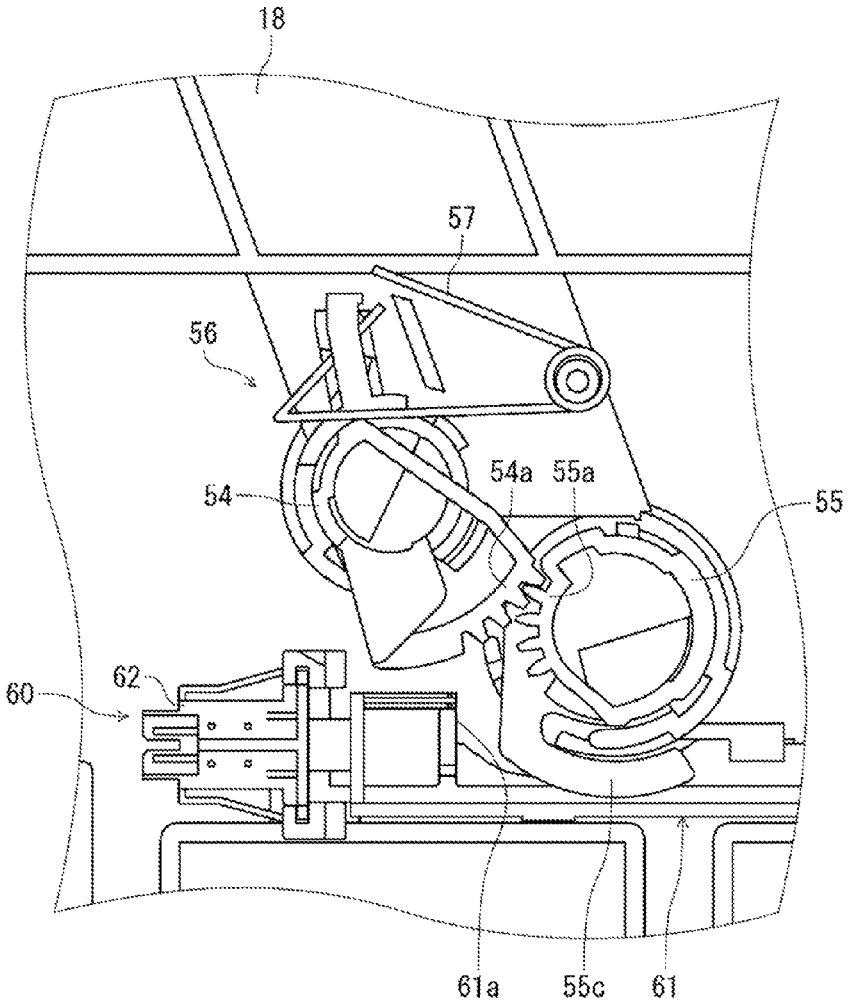
FIG. 19 is an enlarged front view of the drive transmission mechanism, with the lever swung.

The detection bar 61 includes stopped-portions 61*a* each to be stopped by the arm 55*c* of the second rotation portion 55. Four stopped-portions 61*a* are provided, corresponding to the four arms 55*c*. As shown in FIG. 13, when the toner outlet 32 is closed, the stopped-portion 61*a* is stopped by the arm 55*c*, whereby movement of the detection bar 61 toward the tension spring 63 side is restricted. On the other hand, as shown in FIG. 19, when the toner outlet 32 is open, the second rotation portion 55 rotates in the anticlockwise direction, whereby the stopped-portion 61*a* is no longer stopped by the peripheral surface of the arm 55*c*.

Then, as shown in FIG. 11, when all the toner outlets 32 are open, none of the stopped-portions 61*a* are stopped by the peripheral surfaces of the arms 55*c* any longer, and accordingly, the detection bar 61 is pulled by the tension spring 63 to move so as to be distanced from the sensor 62.

When the detection bar 61 is close to the sensor 62 as shown in FIG. 10, the sensor 62 detects an ON state in which at least one toner outlet 32 is closed. When the detection bar 61 is distanced from the sensor 62 as shown in FIG. 11, the sensor 62 detects an OFF state in which all the toner outlets 32 are open.

Next, operation of mounting/dismounting of the toner container 30 to/from the apparatus body 2 will be described.

Figure 8:
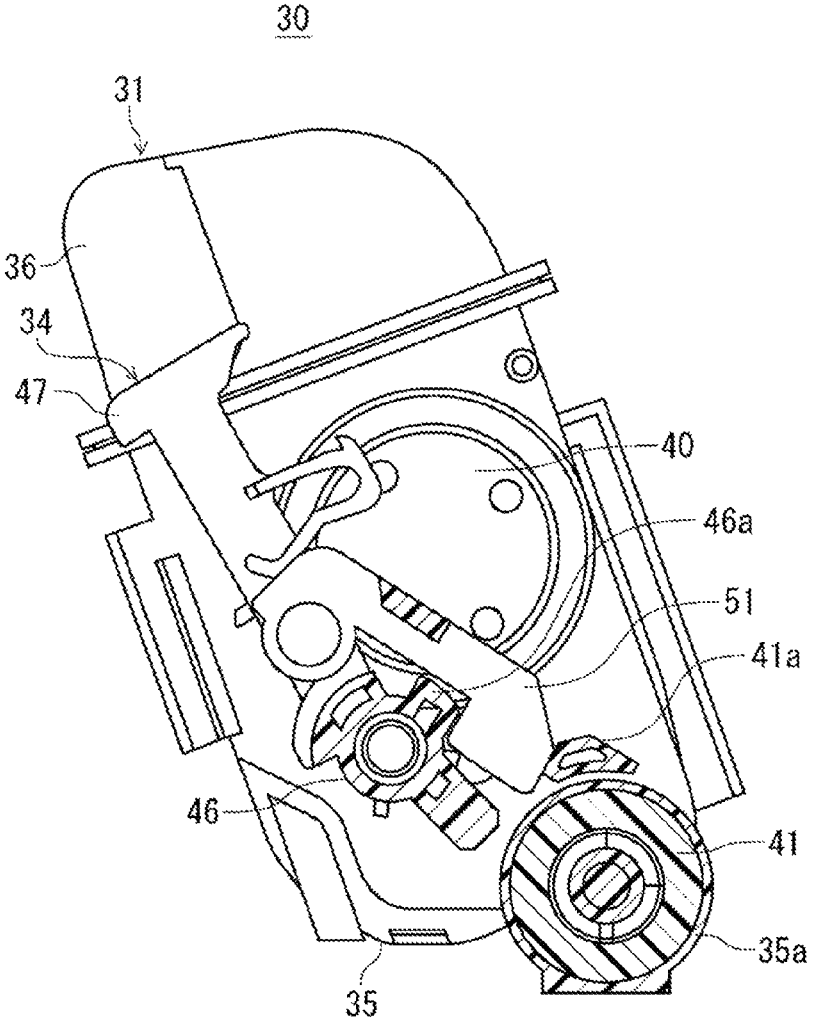
FIG. 8 is a front view, partially broken away, of the toner container.

Before the toner container 30 is mounted to the apparatus body 2, the toner outlet 32 is closed by the shutter cylinder 41, and as shown in FIG. 7 and FIG. 8, the operation portion 34 and the opening and closing mechanism 33 are in a locked state by the lock member 51. At this time, the first connection portion 58 and the first portion 59*a* of the second connection portion 59 each extend in the mounting direction (i.e., diagonally downward) along which the cover member 52 is guided by the container guide 19.

Also, before the toner container 30 is mounted to the apparatus body 2, the first connection groove 54*b* of the first rotation portion 54 and the second connection groove 55*b* of the second rotation portion 55 in the drive transmission mechanism 56 each extend in the direction in which the container guide 19 extends (i.e., the mounting direction along which the cover member 52 is guided) as shown in FIG. 12 and FIG. 13.

When a user is to mount the toner container 30 to the mount portion 18, the user inserts the cover member 52 into the container guide 19 of the mount portion 18. At this time, the cover member 52 is guided diagonally downward by the container guide 19. Further, as shown in FIG. 14 and FIG. 15, the first connection portion 58 of the toner container 30 is guided by the first groove portion 19*a*, and the second connection portion 59 is guided by the second groove portion 19*b*. Thus, the first connection portion 58 is connected into the first connection groove 54*b* of the first rotation portion 54, and the second connection portion 59 is connected into the second connection groove 55*b* of the second rotation portion 55.

As shown in FIG. 15 and FIG. 16, while the cover member 52 is being guided by the container guide 19, the upper end of the protrusion 20 comes into contact with the claw portion 51*a* of the lock member 51 to push up the lock member 51. As a result, in a state where the first connection portion 58 is connected to the first rotation portion 54 and the second connection portion 59 is connected to the second rotation portion 55, the locked state of the operation portion 34 and the opening and closing mechanism 33 of the toner container 30 is released.

Figure 17:
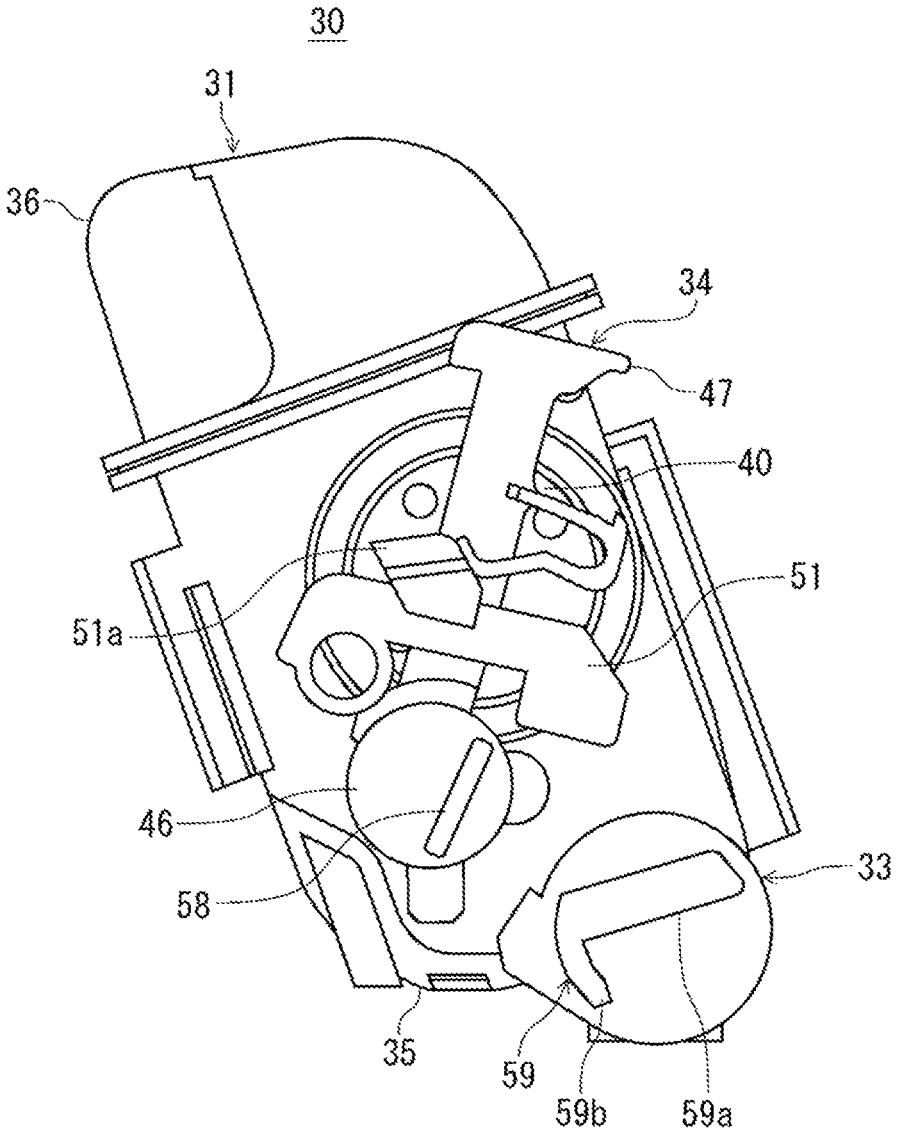
FIG. 17 is a front view showing the toner container with the lever swung.
Figure 18:
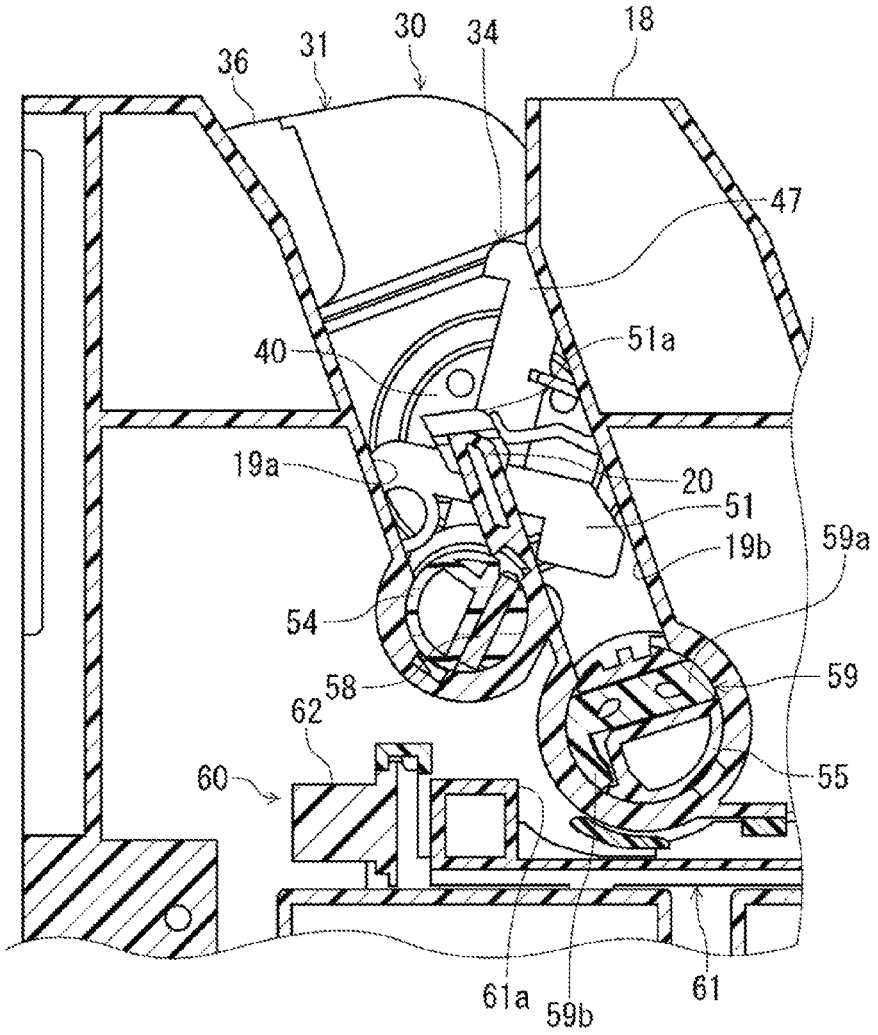
FIG. 18 is a front view, partially broken away, of the toner container mounted to the mount portion with the lever swung.

Next, the user swings the lever 47 of the operation portion 34 to open the toner outlet 32. FIG. 17 to FIG. 19 each show a state where the lever 47 is swung.

When the lever 47 is swung in a state where the toner container 30 is mounted to the mount portion 18, as shown in FIG. 15 to FIG. 18, the shaft portion 46 and the first connection portion 58 rotate in the clockwise direction integrally with the lever 47. That is, the first connection portion 58 rotates by the same angle as the angle by which the lever 47 is swung.

Since the first connection portion 58 is connected to the first rotation portion 54 of the drive transmission mechanism 56, the first connection portion 58 rotates integrally with the first rotation portion 54. As shown in FIG. 13 and FIG. 19, on the apparatus body 2 side, the first gear portion 54*a* of the first rotation portion 54 is meshed with the second gear portion 55*a* of the second rotation portion 55. Thus, the second rotation portion 55 rotates in a direction reverse to the rotation direction of the first rotation portion 54.

Since the second rotation portion 55 is connected to the second connection portion 59 of the toner container 30, the second connection portion 59 rotates integrally with the second rotation portion 55. By the second connection portion 59 rotating, the shutter cylinder 41 rotates integrally with the second connection portion 59.

Thus, by the lever 47 being swung in a state where the toner container 30 is mounted to the apparatus body 2, the shutter cylinder 41 rotates to open the toner outlet 32. Then, when all the toner outlets 32 are opened, the open state is detected by the detection portion 60.

As described above, the image forming apparatus 1 of the present embodiment is configured such that the rotation drive force of the lever 47 in each toner container 30 is transmitted to the opening and closing mechanism 33 for the toner outlet 32 via the drive transmission mechanism 56 provided on the apparatus body 2 side of the image forming apparatus 1. Accordingly, before the casing 31 is mounted to the apparatus body 2, even if the user operates the lever 47 by mistake, the rotation drive force is not transmitted to the opening and closing mechanism 33, and thus, the toner outlet 32 is not opened. Thus, leakage of toner from the casing 31 can be prevented.

Further, the first connection portion 58 and the second connection portion 59 allow the casing 31 to be mounted to the apparatus body 2 of a specific model, but does not allow the casing 31 to be mounted to an apparatus body of another model. Therefore, the toner container 30 can be used by the image forming apparatus 1 of the specific model.

A conventional toner container of an image forming apparatus has a portion that exhibits an incompatibility function. However, if the portion that exhibits the incompatibility function is cut out and an opening made in that cut portion is closed with a taping member or the like, leakage of toner is still prevented, and at the same time, the toner can be still supplied to an image forming apparatus. Therefore, there is a possibility that such a conventional toner container is relatively easily used in a model other than the specified model.

On the other hand, in the case of the image forming apparatus 1 of the present embodiment, the first connection portion 58 and the second connection portion 59 are provided. The first connection portion 58 and the second connection portion 59 are portions that exhibit incompatibility functions of the toner container. If the first connection portion 58 and the second connection portion 59 are cut out, even if the user operates the lever 47 in a state where the casing 31 is mounted to the apparatus body 2, the rotation drive force of the lever 47 is not transmitted to the opening and closing mechanism 33 by the drive transmission mechanism 56. Therefore, the function of the toner container 30 of discharging toner from the toner outlet 32 cannot be exhibited.

That is, according to the present embodiment, if the first connection portion 58 and the second connection portion 59 are cut out, the function of the toner container 30 cannot be exhibited. Thus, a situation where toner of a type different from the type of the toner applicable to the image forming apparatus 1 is used in the image forming apparatus 1 can be appropriately prevented.

Further, the lock member 51 which puts the operation portion 34 and the opening and closing mechanism 33 into a locked state is provided. Thus, before the toner container 30 is mounted to the apparatus body 2, the operation portion 34 and the opening and closing mechanism 33 are in a locked state by the lock member 51, and thus, erroneous operation of the operation portion 34 can be prevented, and erroneous operation of the opening and closing mechanism 33 resulting in opening and closing of the toner outlet 32 can be prevented. Further, the locked state of the operation portion 34 and the opening and closing mechanism 33 is released in conjunction with mounting operation of the toner container 30 to the apparatus body 2, and thus, operation to release the locked state is not required.

In the present embodiment, the configuration in which the drive transmission mechanism 56 includes the first and second gear portions 54*a* and 55*a* has been described. However, the present disclosure is not limited thereto. For example, a configuration in which a transmission belt is wound around the first rotation portion 54 and the second rotation portion 55 may be employed.

In the present embodiment, a laser printer has been described as one example of the image forming apparatus 1. However, the image forming apparatus 1 according to the present disclosure is not limited thereto, and may be, for example, another image forming apparatus such as a copy machine, a scanner device, or a multifunction peripheral.

As described above, the present disclosure is useful for a toner container and an image forming apparatus including the toner container.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus body;

a toner container configured to be mounted to the apparatus body; and a drive transmission mechanism provided in the apparatus body, wherein the apparatus body includes a mount portion of a plate-like shape to which an end portion of the toner container is mounted, the end portion being on one side in a longitudinal direction of the toner container, the toner container includes a casing configured to contain toner, a toner outlet formed in the casing, an opening and closing mechanism provided in a side end portion of the casing that is on the one side and configured to open and close the toner outlet, and an operation portion provided in the side end portion of the casing, the drive transmission mechanism includes a first rotation portion, and a second rotation portion configured to rotate in conjunction with the first rotation portion, the first rotation portion and the second rotation portion being disposed adjacent to each other on a surface of the mount portion, the operation portion includes a first connection portion configured to rotate by the operation portion being operated, and configured to be disposed on a same axis as the first rotation portion and connected to the first rotation portion of the drive transmission mechanism so as to be rotatable integrally with the first rotation portion, by the toner container being mounted to the apparatus body, and the opening and closing mechanism includes a second connection portion disposed adjacent to the first connection portion on the side end portion and configured to be disposed on a same axis as the second rotation portion and connected to the second rotation portion of the drive transmission mechanism so as to be rotatable integrally with the second rotation portion, by the toner container being mounted to the apparatus body, and is configured to open and close the toner outlet by the second connection portion being rotated, wherein the first rotation portion includes a first connection groove having at least a portion thereof extending linearly, the second rotation portion includes a second connection groove having at least a portion thereof extending linearly, the first connection portion is formed so as to be able to fit into the first connection groove of the first rotation portion, and the second connection portion is formed so as to be able to fit into the second connection groove of the second rotation portion.

2. The image forming apparatus according to claim 1, wherein a width of the first connection groove is different from a width of the second connection groove.

3. The image forming apparatus according to claim 1, wherein the toner container includes a lock member which puts the operation portion into a locked state so as to restrict operation of the operation portion, and the lock member is configured to, when the toner container is mounted to the apparatus body, come into contact with a protrusion formed in the apparatus body to release the locked state of the operation portion by the lock member.

4. The image forming apparatus according to claim 1, wherein the first rotation portion includes a first gear portion, and the second rotation portion includes a second gear portion meshed with the first gear portion.

5. A toner container comprising:

a casing configured to be mounted to an apparatus body of an image forming apparatus, and configured to contain toner;

a toner outlet formed in the casing;

an opening and closing mechanism provided in the casing and configured to open and close the toner outlet; and an operation portion provided in the casing, wherein the apparatus body, provided with a drive transmission mechanism including a first rotation portion and a second rotation portion configured to rotate in conjunction with the first rotation portion, includes a mount portion of a plate-like shape to which an end portion of the toner container is mounted, the end portion being on one side in a longitudinal direction of the toner container, the operation portion includes a first connection portion configured to rotate by the operation portion being operated, and configured to be disposed on a same axis as the first rotation portion and connected to the first rotation portion of the drive transmission mechanism so as to be rotatable integrally with the first rotation portion, by the casing being mounted to the apparatus body, and the opening and closing mechanism, provided in a side end portion of the casing that is on the one side and configured to open and close the toner outlet, includes a second connection portion disposed adjacent to the first connection portion on the side end portion and configured to be disposed on a same axis as the second rotation portion and connected to the second rotation portion of the drive transmission mechanism so as to be rotatable integrally with the second rotation portion, by the casing being mounted to the apparatus body, and is configured to open and close the toner outlet by the second connection portion being rotated, wherein the first rotation portion includes a first connection groove having at least a portion thereof extending linearly, the second rotation portion includes a second connection groove having at least a portion thereof extending linearly, the first connection portion is formed so as to be able to fit into the first connection groove of the first rotation portion, and the second connection portion is formed so as to be able to fit into the second connection groove of the second rotation portion.

* * * * *